US008732880B2

(12) United States Patent
Carrothers-Smith

(10) Patent No.: US 8,732,880 B2
(45) Date of Patent: May 27, 2014

(54) DIAPER CHANGING STATION ASSEMBLY

(76) Inventor: Chante L. Carrothers-Smith, Chicago, IL (US)

( * ) Notice: Subject to any disclaimer, the term of this patent is extended or adjusted under 35 U.S.C. 154(b) by 275 days.

(21) Appl. No.: 13/285,087

(22) Filed: Oct. 31, 2011

(65) Prior Publication Data

US 2013/0104310 A1 May 2, 2013

(51) Int. Cl.
*A47C 20/00* (2006.01)

(52) U.S. Cl.
USPC ..... 5/655; 5/630; 5/417; 5/420; 5/691; 5/652; 5/653; 5/657

(58) Field of Classification Search
USPC ..... 5/630, 417, 420, 691, 652, 653, 655, 5/657
See application file for complete search history.

(56) References Cited

U.S. PATENT DOCUMENTS

| | | | | |
|---|---|---|---|---|
| 3,865,110 | A | 2/1975 | Traverse | |
| 3,877,432 | A | 4/1975 | Gellert | |
| 3,879,775 | A * | 4/1975 | Iwata | 5/639 |
| 4,923,455 | A | 5/1990 | Dean et al. | |
| 4,964,589 | A | 10/1990 | Okada | |
| 5,414,881 | A * | 5/1995 | Terrazas | 5/417 |
| D386,582 | S | 11/1997 | Levine | |
| D393,713 | S | 4/1998 | Gubbiotti | |
| 5,884,331 | A * | 3/1999 | Barajas | 2/69 |
| 6,454,748 | B1 | 9/2002 | Ives | |
| 6,618,883 | B2 * | 9/2003 | Angland | 5/659 |
| 2003/0192121 | A1 * | 10/2003 | Fleming et al. | 5/420 |
| 2005/0038403 | A1 | 2/2005 | Singleton | |
| 2006/0020252 | A1 | 1/2006 | Strong | |
| 2006/0282056 | A1 | 12/2006 | McDonald | |
| 2008/0028529 | A1 * | 2/2008 | Abell | 5/640 |
| 2008/0029103 | A1 * | 2/2008 | Regev et al. | 128/875 |
| 2009/0007337 | A1 * | 1/2009 | Mese | 5/655 |
| 2009/0158527 | A1 * | 6/2009 | Skophammer | 5/655 |
| 2011/0023236 | A1 * | 2/2011 | Sanders et al. | 5/655 |
| 2011/0119832 | A1 * | 5/2011 | Hung | 5/655 |
| 2012/0090094 | A1 * | 4/2012 | Whitlock Petersen | 5/655 |
| 2012/0233772 | A1 * | 9/2012 | Wang | 5/417 |

* cited by examiner

*Primary Examiner* — William Kelleher

(57) ABSTRACT

A diaper changing station assembly includes a mat that has a top side, a bottom side and a peripheral edge. The peripheral edge includes a front side, a back side, a first lateral side and a second lateral side. A top pad is attached to and covers a portion of the top side. A bottom pad has a top surface, a bottom surface and a peripheral edge. The bottom surface is attached to and covers a portion of the bottom side. A portion of the bottom pad is unattached to the mat adjacent to the peripheral edge to define a bag pocket extending between the mat and the bottom pad. The bag is removable from the pocket after the soiled diaper is changed to receive the mat. The bag is configured to receive the soiled diaper for disposal of the mat and the soiled diaper.

3 Claims, 3 Drawing Sheets

DIAPER CHANGING STATION ASSEMBLY

BACKGROUND OF THE DISCLOSURE

Field of the Disclosure

The disclosure relates to diaper changing station devices and more particularly pertains to a new diaper changing station device for providing a disposable surface for changing a diaper.

SUMMARY OF THE DISCLOSURE

An embodiment of the disclosure meets the needs presented above by generally comprising a mat that has a top side, a bottom side and a peripheral edge. The peripheral edge includes a front side, a back side, a first lateral side and a second lateral side. A top pad is attached to and covers a portion of the top side. The top pad is comprised of a resiliently compressible and water absorbent material. A bottom pad has a top surface, a bottom surface and a peripheral edge. The bottom surface is attached to and covers a portion of the bottom side. A portion of the bottom pad is unattached to the mat adjacent to the peripheral edge to define a bag pocket extending between the mat and the bottom pad.

A bag is removably inserted into the bag pocket. The mat is configured to be laid on a surface so the bottom pad abuts the surface and a child laid upon the top pad for changing of a soiled diaper. The bag is removable from the pocket after the soiled diaper is changed to receive the mat. The bag is configured to receive the soiled diaper for disposal of the mat and the soiled diaper.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
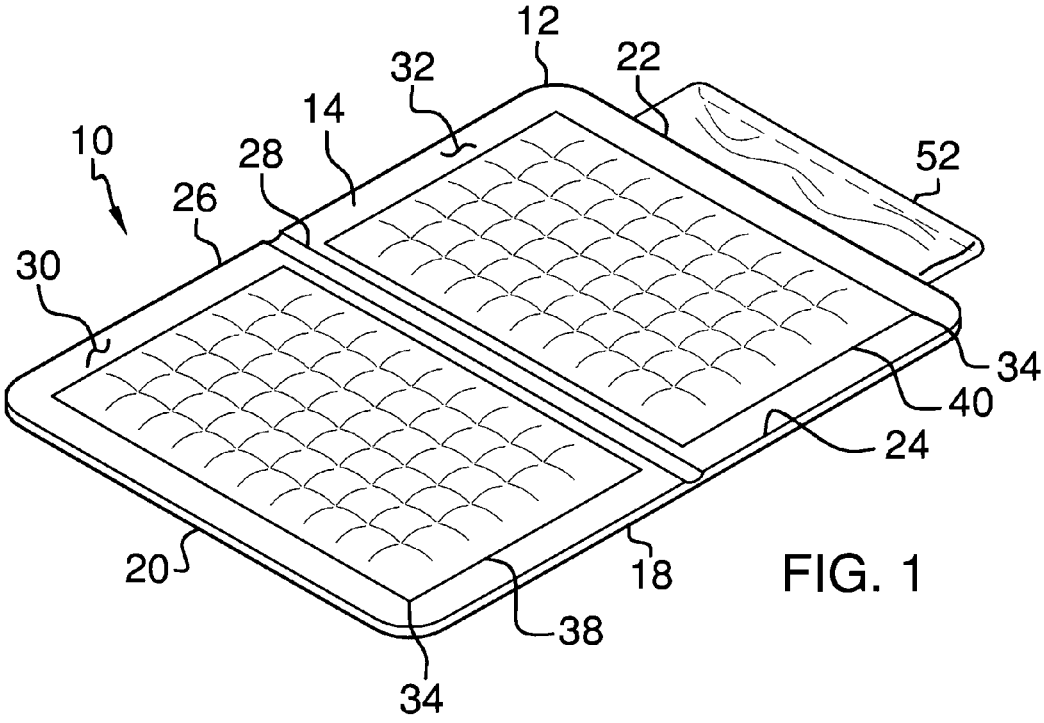
FIG. 1 is a top perspective view of a diaper changing station assembly according to an embodiment of the disclosure.
Figure 2:
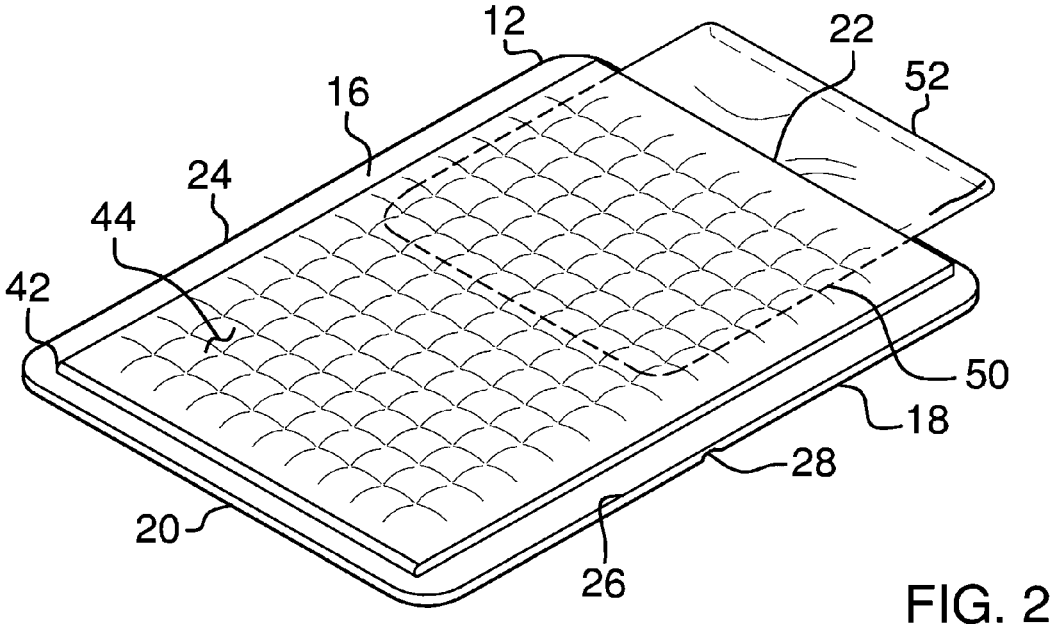
FIG. 2 is a bottom perspective view of an embodiment of the disclosure.
Figure 3:
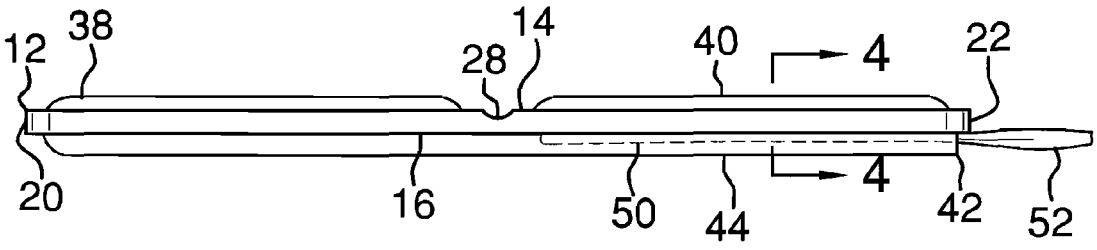
FIG. 3 is a left side view of an embodiment of the disclosure.
Figure 4:
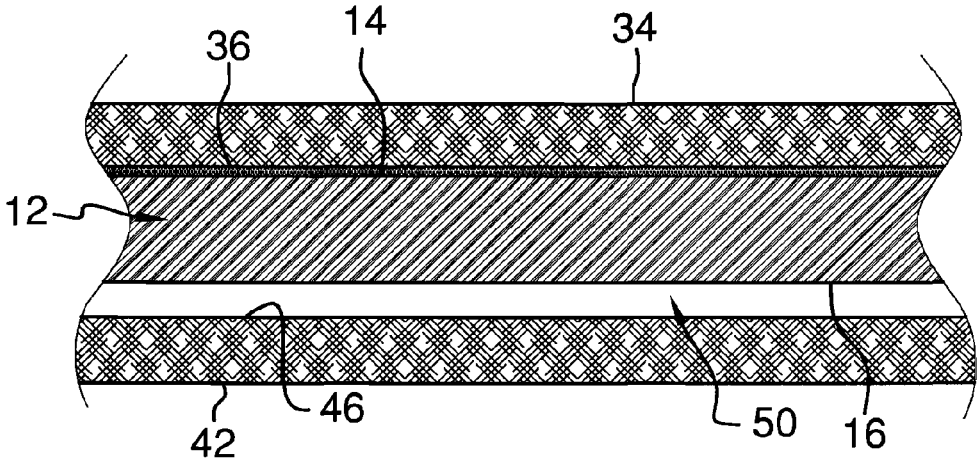
FIG. 4 is a cross sectional view taken along line 4 of FIG. 3 of an embodiment of the disclosure.
Figure 5:
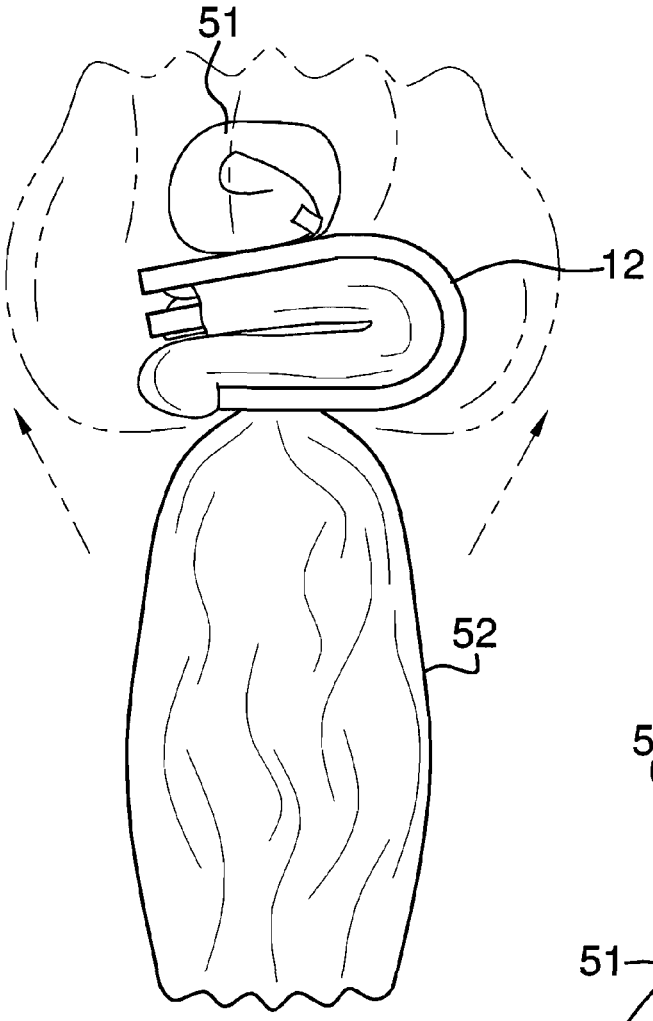
FIG. 5 is a cutaway in-use view of an embodiment of the disclosure.
Figure 6:
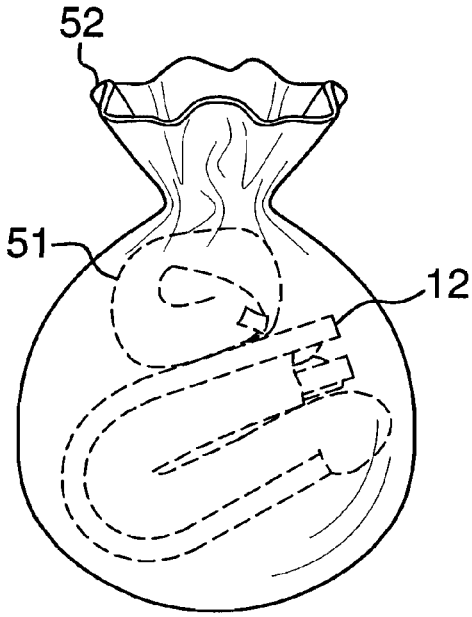
FIG. 6 is a phantom in-use view of an embodiment of the disclosure.

With reference now to the drawings, and in particular to FIGS. 1 through 6 thereof, a new diaper changing station device embodying the principles and concepts of an embodiment of the disclosure and generally designated by the reference numeral 10 will be described.

As best illustrated in FIGS. 1 through 6, the diaper changing station assembly 10 generally comprises a mat 12 that has a top side 14, a bottom side 16 and a peripheral edge 18. The peripheral edge 18 includes a front side 20, a back side 22, a first lateral side 24 and a second lateral side 26. The top side 14 has a groove 28 in it extending through and between each of the first 24 and second 26 lateral sides to facilitate folding of the mat 12 such that the top side 14 abuts itself and the front 20 and back 22 sides are adjacent to each other. The groove 28 defines a first section 30 of the top side 14 extending from the groove 16 to the front side 20 and a second section 32 of the top side 14 extending from the groove 28 to the back side 22.

A top pad 34 is attached to and covers a portion of the top side 14. The top pad 34 may be attached to the top side 14 using an adhesive material 36. The top pad 34 may be comprised of a resiliently compressible and water absorbent material such as cotton or other similar material. The top pad 34 includes a first top pad portion 38 that is mounted on the first section 30 and a second top pad portion 40 that is mounted on the second section 32.

A bottom pad 42 has a top surface 44, a bottom surface 46 and a peripheral edge 48. The bottom surface 46 is attached to and covers a portion of the bottom side 16. The bottom surface 46 may be attached to the bottom side 16 using an adhesive layer 36. The bottom pad 42 may be comprised of a resiliently compressible and water absorbent material such as cotton or other similar material. A portion of the bottom pad 42 is unattached to the mat 12 adjacent to the peripheral edge 18 to define a bag pocket 50 that extends between the mat 12 and the bottom pad 42. A bag 52 is removably inserted into the bag pocket 50. The bag 52 may be comprised of a deformable and water resistant material such as plastic or other similar material.

The mat 12 is configured to be laid on a surface so the bottom pad 42 abuts the surface and has a child laid upon the top pad 34 for changing of a soiled diaper 51. The bag 52 may be removable from the bag pocket 50 after the soiled diaper 51 is changed to receive the mat 12 and the soiled diaper 51 for disposal of the mat 12 and the soiled diaper 51.

In use, the mat 12 can be laid upon a surface so the bottom pad 42 abuts the surface. A child may be laid upon the top pad 34 to change a soiled diaper 51. After the soiled diaper 51 is changed, the bag 52 may be removed from the bag pocket 50. The mat 12 may be folded in half along the groove 28 and then inserted into the bag 52 along with the soiled diaper 51 for disposal of both the soiled diaper 51 and the mat 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A diaper changing station assembly configured for providing a disposable surface for changing a diaper, said assembly comprising:

a mat having a top side, a bottom side and a peripheral edge, said peripheral edge including a front side, a back side, a first lateral side and a second lateral side;

a top pad being attached to and covering a portion of said top side, said top pad being comprised of a resiliently compressible and water absorbent material;

a bottom pad having a top surface, a bottom surface and a peripheral edge, said bottom surface being attached to and covering a portion of said bottom side;

a portion of said bottom pad being unattached to said mat adjacent to said peripheral edge to define a bag pocket extending between said mat and said bottom pad;

a bag being removably inserted into said bag pocket;

wherein said mat is configured to be laid on a surface having said bottom pad abut the surface and having a child laid upon said top pad for changing of a soiled diaper; and wherein said bag is removable from said pocket after the soiled diaper is changed to receive said mat, said bag being configured to receive the soiled diaper for disposal of said mat and the soiled diaper.

2. The assembly according to claim 1, wherein said top side has a groove therein extending through and between each of said first and second lateral sides to facilitate folding of said mat such that said top side abuts itself having said front and back sides being adjacent to each other, said groove defining a first section of said top side extending from said groove to said front side and a second section of said top side extending from said groove to said back side.

3. A diaper changing station assembly configured for providing a disposable surface for changing a diaper, said assembly comprising:

a mat having a top side, a bottom side and a peripheral edge, said peripheral edge including a front side, a back side, a first lateral side and a second lateral side, said top side having a groove therein extending through and between each of said first and second lateral sides to facilitate folding of said mat such that said top side abuts itself having said front and back sides being adjacent to each other, said groove defining a first section of said top side extending from said groove to said front side and a second section of said top side extending from said groove to said back side;

a top pad being attached to and covering a portion of said top side, said top pad being comprised of a resiliently compressible and water absorbent material, said top pad including a first top pad portion being mounted on said first section and a second top pad portion being mounted on said second section;

a bottom pad having a top surface, a bottom surface and a peripheral edge, said bottom surface being attached to and covering a portion of said bottom side;

a portion of said bottom pad being unattached to said mat adjacent to said peripheral edge to define a bag pocket extending between said mat and said bottom pad;

a bag being removably inserted into said bag pocket;

wherein said mat is configured to be laid on a surface having said bottom pad abut the surface and having a child laid upon said top pad for changing of a soiled diaper; and wherein said bag is removable from said pocket after the soiled diaper is changed to receive said mat, said bag being configured to receive the soiled diaper for disposal of said mat and the soiled diaper.

* * * * *